US005595404A

United States Patent [19]

Skees

[11] Patent Number: 5,595,404

[45] Date of Patent: Jan. 21, 1997

[54] MAILER INTERMEDIATE OR BUSINESS FORM

[75] Inventor: Hugh B. Skees, Dayton, Ohio

[73] Assignee: The Standard Register Company, Dayton, Ohio

[21] Appl. No.: 387,554

[22] Filed: Feb. 13, 1995

[51] Int. Cl.[6] ..... B42D 15/00

[52] U.S. Cl. ..... 283/116; 283/62

[58] Field of Search ..... 283/116, 56, 117, 283/62, 61; 462/64, 65

[56] References Cited

U.S. PATENT DOCUMENTS

| | | | |
|---|---|---|---|
| 4,597,591 | 7/1986 | Gendron et al. | 283/116 |
| 4,632,428 | 12/1986 | Brown . | |
| 4,982,894 | 1/1991 | Schmidt . | |
| 4,986,868 | 1/1991 | Schmidt . | |
| 5,045,426 | 9/1991 | Maierson et al. . | |
| 5,096,229 | 3/1992 | Carlson . | |
| 5,131,686 | 7/1992 | Carlson . | |
| 5,172,938 | 12/1992 | Schmidt . | |
| 5,183,436 | 2/1993 | Shanley . | |
| 5,219,183 | 6/1993 | McKillip . | |
| 5,281,799 | 1/1994 | McIntire et al. . | |
| 5,372,385 | 12/1994 | Sufuentes et al. . | |
| 5,376,048 | 12/1994 | Whiteside | 283/116 X |
| 5,464,255 | 11/1995 | Schildmeyer | 283/116 |

*Primary Examiner*—Willmon Fridie, Jr.

*Attorney, Agent, or Firm*—Killworth, Gottman, Hagan & Schaeff

[57] ABSTRACT

A mailer or business form intermediate including a built-in two-ply card is provided. The mailer comprises a single substrate sheet divided into three or four panels. The two-ply card is fashioned from lines of weakness forming single card plies in two adjacent panels which when folded come into contact and are held together with adhesive to form the two-ply card. Additional adhesives are employed to seal the mailer. Alternative embodiments include four panels in a side-by-side arrangement or a business form embodiment wherein the additional adhesives are not employed.

19 Claims, 13 Drawing Sheets

MAILER INTERMEDIATE OR BUSINESS FORM

BACKGROUND OF THE INVENTION

This invention relates to a mailer intermediate or business form, and more particularly to a mailer intermediate or business form including a two-ply card.

In recent years, a rising demand for identification cards of various types, such as membership cards or insurance cards, has led to an increased demand for mailer intermediates or business forms which include such cards. The recent rise in computer automated mailing systems involving automated printing, such as laser, impact, ink jet, and thermal transfer printers, has led to an effort to develop improved mailer intermediates or business forms which may be printed in such automated systems, preferably in one pass through the printing system.

U.S. Pat. No. 4,632,428 to Brown discloses a combination medical data and health insurance information card. The card comprises panels of plastic material which may be folded and a photograph, microfilm or other information may be inserted in between the panels so that when folded the information appears through the plastic. However, Brown does not disclose a single sheet substrate which may be passed through a printing system then folded into a mailer intermediate or business form containing a two-ply card.

U.S. Pat. No. 5,172,938 to Schmidt discloses an I.D. card product. The product comprises a single panel sheet having an I.D. card formed into the panel. The card has a transparent film attached to the card on the panel so that when the card is received information can be filled in on the card then the film placed on top to protect the card face. However, Schmidt does not disclose a multi-panel, single sheet substrate which may be folded to a mailer intermediate or business form containing a two-ply card.

U.S. Pat. No. 5,219,183 to McKillip discloses a printable sheet having a separable card. The sheet in McKillip is a sheet of normal business sized letter sheet adapted to be inserted into an envelope for mailing. Identification cards may be provided on the sheet. However, McKillip does not disclose a multi-panel, single sheet substrate mailer intermediate or business form which may be folded to provide a two-ply card.

U.S. Pat. No. 5,183,436 to Shanley discloses folded membership mailers. The mailer comprises a substrate upon which a card is provided. After being passed through a printing process an overlay sheet covering the card and information is applied. This overlay acts as the outer surface of a mailing envelope. When received, the overlay is removed gaining access to the card and the information. Thus, Shanley fails to disclose a multi-panel, single sheet substrate which may be folded into a mailer intermediate or business form including a two-ply card.

U.S. Pat. No. 5,096,229 to Carlson discloses a sheetstock for preparing mailers. The sheetstock includes a first layer which is printable and has a die-cut card formed therein. A second layer is adhered to the first to allow the sheetstock to pass through the printer easily. However, Carlson also fails to discloses a multi-panel, single sheet substrate which may be folded to form a mailer intermediate or business form.

Accordingly, there remains a need in the art for an improved mailer or business form which is generated from a single sheet substrate, has multiple panels and may be folded to form a two-ply card for membership or identification purposes.

SUMMARY OF THE INVENTION

This need is met by the present invention whereby an improved mailer or business form intermediate including a built-in two-ply card is provided. The mailer of the present invention is made from a single sheet of substrate which is divided into multiple panels. The two-ply card is formed by folding the mailer intermediate. The mailer includes areas for the printing of variable or non-variable information. The mailer may be either simplex or duplex printed in continuous or cut sheet format. Additionally, the mailer is easy to open and requires no additional steps by the end user to form the two-ply card.

In accordance with one aspect of the present invention, a mailer or business form intermediate is provided. The mailer intermediate comprises a substrate sheet having first and second surfaces, first and second opposing longitudinal edges and first and second opposing end edges. At least first and second transverse fold lines are formed in the substrate perpendicular to the parallel longitudinal edges thereby dividing the substrate into at first, second and third panels. The first fold line separates the first and second panels and the second fold line separates the second and third panels.

Lines of weakness are disposed in the first and second panels thereby forming first and second plies, respectively. First and second plies form the individual components of the two-ply card. A first adhesive pattern is provided on the second surface of at least one of the first or second plies so that, when the substrate sheet is folded about the first fold line, the second surfaces of the first and second plies lie in contact thereby forming a two-ply card.

To secure the mailer intermediate of the present invention, additional adhesive patterns may be employed. A second adhesive pattern may be provided on the second surface in at least one of the first and second panels, preferably adjacent the longitudinal edges. Thus, when the mailer is folded about the first fold line, the second adhesive pattern will allow the first and second panels better adherence than through the first adhesive pattern only. A third adhesive pattern may be provided on at least one of the first surface of the first panel and the second surface of the third panel (C-fold) or on the first surface of at least one of the second panel and the third panel (Z-fold). Thus, when the mailer is folded about the second fold line in a C-fold arrangement, the third and first panels will adhere. Alternatively, the third adhesive pattern can be provided on at least one of the first surface of the second panel or the first surface of the third panel. This will allow the third and second panels to adhere when the mailer is folded about the second fold line in a Z-fold arrangement. Lastly, a fourth adhesive pattern may be provided adjacent either of the first or second opposite end edges to seal the ends of the mailer.

To allow easy opening of the mailer of the present invention once received at its destination, lines of weakness may be included adjacent the first and second longitudinal edges in the at least first, second and third panels. Additionally, if so desired, an address window may be formed in one of the panels.

In a further embodiment of the present invention, a fourth panel is provided in the substrate sheet adjacent the third panel and separated by a third fold line. In this arrangement the mailer of the present invention is a four panel mailer. To allow easy opening of the four panel mailer of the present invention once received at its destination, lines of weakness may be included adjacent the first and second longitudinal edges in the first, second, third and fourth panels. Additionally, if so desired, an address window may be formed in one of the panels.

Adhesives are again employed to seal the mailer. A second adhesive pattern may be provided on the second surface of at least one of the first or second panels to allow better adherence of the first and second panel when the mailer is folded about the first fold line. A third and fourth adhesive pattern may be used to seal the remaining panels of the mailer. The third adhesive pattern may be provided on at least one of the second surface of the third panel and on the first surface of the first panel. The fourth adhesive pattern may be provided on at least one of the first surface of the second panel and the second surface of the fourth panel. This seals the mailer when the mailer has been folded in a double C-fold arrangement. Alternatively, the third pattern may be provided on the first surface of at least one of the second and third panels and a fourth adhesive pattern on the first surface of at least one of the first and fourth panels. This arrangement seals the mailer intermediate of the present invention when the mailer is folded in a double V-fold arrangement.

In an additional embodiment of the present invention, there is provided a business form or mailer having four panels in a side-by-side arrangement. A substrate sheet is provided having first and second surfaces. First and second fold lines are formed in the substrate dividing the substrate into first, second, third and fourth panels. The first fold line separates the first and second panels from the third and fourth panels while the second fold line which is perpendicular to the first fold line, separates the first and third panels from the second and fourth panels.

To form a two-ply card, lines of weakness are formed in two adjacent panels thereby forming first and second plies, respectively. A first adhesive pattern is provided on the first surface of at least one of the first and second plies so that when the substrate sheet is folded about one of the fold lines, the first and second plies lie in contact which each other and adhere forming a two-ply card.

To seal the mailer of this embodiment, a second adhesive pattern may be provided on the first surface of at least one of the first, second, third or fourth panels. Further, a third adhesive pattern may be disposed on the second surface of at least one of the first, second, third or fourth panels. In this fashion, when the mailer is folded about one fold line then about the other, the second and third adhesive patterns hold the mailer together. Lastly, an address window may be provided in one of the four panels.

Accordingly, it is a feature of the present invention to provide a mailer or business form intermediate having a built-in two-ply card. It is further a feature of the present invention to provide either a three panel or four panel mailer intermediate containing a built-in two-ply card. These, and other features and advantages of the present invention will become apparent from the following detailed description, the accompanying drawings and the appended claims.

DETAILED DESCRIPTION OF THE PREFERRED EMBODIMENTS

The present invention relates to a mailer or business form intermediate which contains a built-in two-ply card. The mailer intermediate or business form includes both three panel and four panels embodiments and is suitable for simplex or duplex printing of both variable and non-variable information such as identification numbers, names and instructions. The printing may be accomplished with the various automated printers common today including impact, laser, thermal transfer and ink jet printers. The mailer intermediate is ideally suited for the mailing of insurance or identification cards and information. Further, the mailer intermediate is available in a continuous series in a folded pack, or in single cut sheets.

The mailer intermediate or business form may be used for a variety of end uses. For instance, the present invention may be employed as a business form wherein the form is printed, folded and placed into a mailing envelope or package. Alternatively, the present invention can be employed as a mailer intermediate, whereby the form is printed, folded, and sealed thereby functioning as its own mailing package. Although both embodiments are clearly encompassed, the invention will be explained with reference to the preferred mailer intermediate embodiments as disclosed in the accompanying figures.

Figure 2:
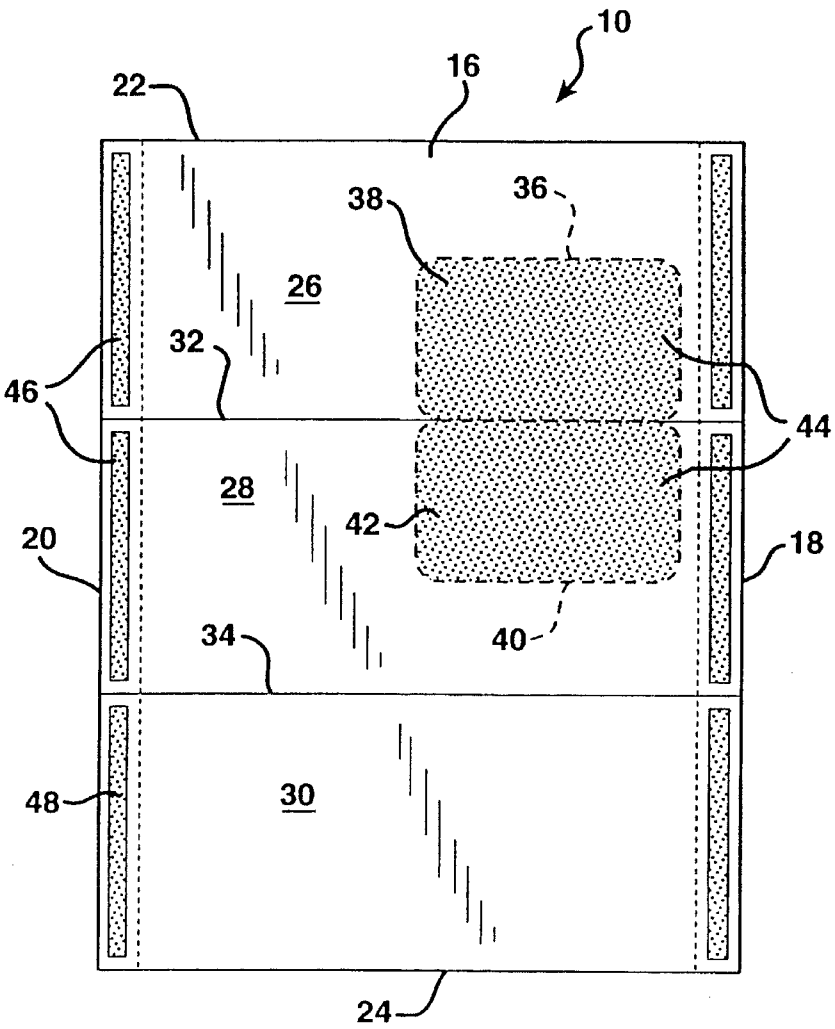
FIG. 2 is a plan view of the back (second) side of the embodiment of FIG. 1.
Figure 1:
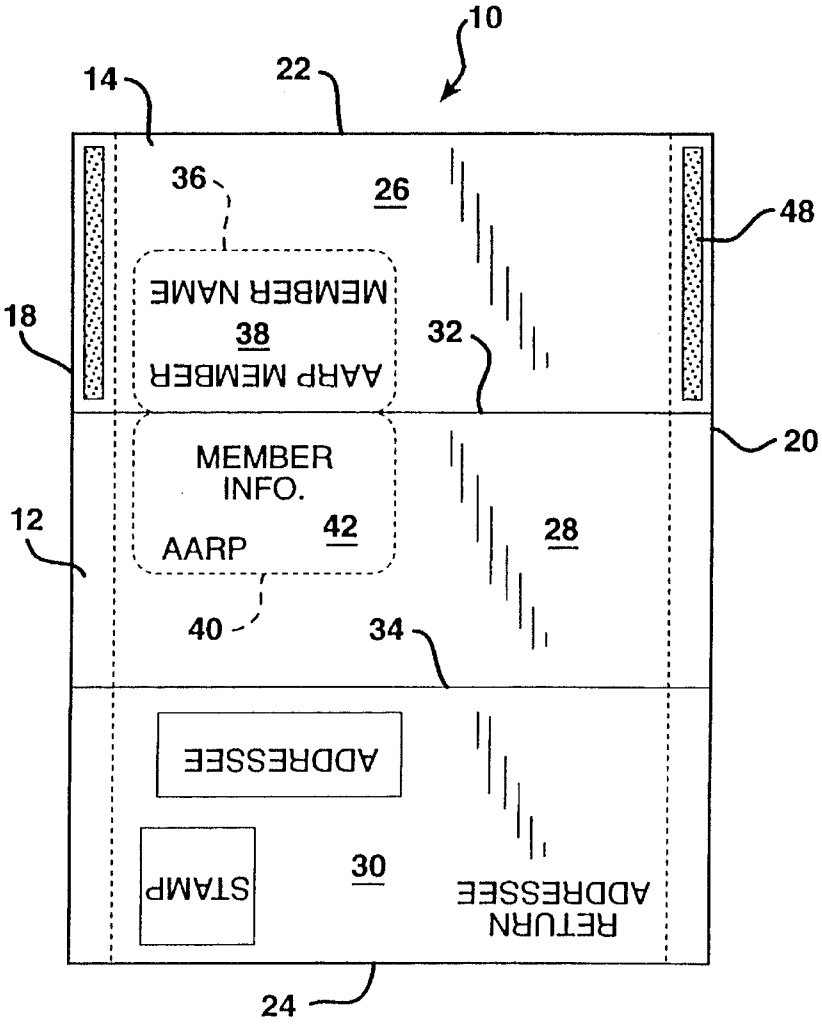
FIG. 1 is a plan view of the front (first) side of one embodiment of the business form or mailer intermediate of the present invention showing adhesive location for a C-fold arrangement.

Referring now to FIGS. 1 and 2, a first embodiment of the mailer intermediate of the present invention is shown. Mailer intermediate 10 includes a substrate sheet 12. Substrate sheet 12 may be of any known material common in the art for substrate purposes, such as paper of various weights, plastic or composite. Substrate sheet 12 includes first surface 14 and second surface 16, first longitudinal edge 18, second longitudinal edge 20, first end edge 22 and second end edge 24. First and second longitudinal edges 18 and 20, respectively, are opposite and parallel each other. First and second end edges 22 and 24, respectively, also are opposite one another.

Substrate 12 may be uncoated or coated on one or both of the first and second surfaces, 14 and 16. Preferably, substrate 12 is a paper coated on first surface 14 with a coating that enhances the bonding of toner images from various printers. Known coatings of this type make the image more durable and may impart gloss to the substrate which contributes an aesthetic appearance. Toner adhesion enhancing coatings are known in the prior art and include those described in U.S. Pat. No. 5,045,426, the disclosure of which is hereby incorporated by reference.

Substrate 12 is divided into at least a first panel 26, a second panel 28 and a third panel 30 by means of at least a first fold line 32 and a second fold line 34. Either of the two fold lines 32 and 34 may be a line of weakness, such as a partial die cut or a line of perforations, to facilitate removal of any of the panels by the user, should that be desired. First fold line 32 separates first panel 26 and second panel 28, while second fold line 34 separates second panel 28 and third panel 30.

To form the built-in two-ply card of the present invention, lines of weakness 36 are provided in the first panel, thereby defining a first card ply 38. Additionally, lines of weakness 40 are provided in second panel 28, thereby defining a second card ply 42. Lines of weakness 36 and 40 may be either lines of perforations or partial die-cuts. A first adhesive pattern 44 is then provided on the second surface 16 of either first ply 38, second ply 42, or both. The first adhesive pattern may be coated on all or any portion of first and second plies, 38 and 42, such as along the peripheral edges. First adhesive pattern 44 may be a hot-melt or heat-seal adhesive, remoist adhesive, or a pressure sensitive adhesive, all of which adhesives are well-known in the art.

First and second card plies 38 and 42, respectively, may be positioned in any location within the first and second panels 26 and 28, respectively. The only constraint in the position of first and second card plies 38 and 40 being that the plies 38 and 42 be oriented such that, when mailer 10 is folded about first fold line 32, the second surfaces of the two card plies 38 and 42 come into contact. Thus, first adhesive pattern 44 can then function to adhere first ply 38 to second ply 42 to form the two-ply card (not shown). If desired, first and second plies 38 and 42 may also be laminated by any procedure known in the art, such as, for example, the methods of U.S. Pat. No. 5,096,229 and U.S. Pat. No. 5,131,686, the disclosures of which are both herein incorporated by reference.

First and second plies 38 and 42 may be of any desired size or portion within their respective panels. Preferably, the card plies are smaller in size than an entire panel and are of common sizes for identification or membership cards, such as about 3⅜ inches by 2⅛ inches. However, first and second plies 38 and 42 may also be of standard postcard size, such as about 3½ inches by 5 inches. In this embodiment, the mailer 10 may include a two-ply postcard for mail-back purposes. The two-ply postcard may contain pre-printed return addresses, prepaid postage, order information, or various other variable and nonvariable information, on the first surface 14 of either the first ply 38 or the second ply 42. In addition, various other products in which it may be convenient to create the thickness and stiffness of card stock from two lighter plies are encompassed by the present invention. By variable information, it is meant information which varies from mailer to mailer, such as address or identification number information. By nonvariable information, it is meant information that remains the same from mailer to mailer, such as return address information.

A number of adhesive patterns may be disposed on substrate sheet 12 in order to secure the mailer 10 together once it is folded. A second adhesive pattern 46 may be provided on at least one of the first or second panels 26 and 28, respectively. Second adhesive pattern 46 is disposed on the second surface 16 in either the first panel 26, the second panel 28, or both, depending on the adhesive employed. Of course, one of ordinary skill in the art will recognize that certain adhesives, such as pressure seal or self adhesives (sometimes called self-stick), require corresponding adhesive patterns on both surfaces to adhere to each other, as shown in FIG. 2. Second adhesive pattern 46 seals first panel 26 and second panel 28, and is preferably disposed adjacent the longitudinal edges 18 and 20. Again, second adhesive pattern can be a hot-melt, remoist, pressure seal or pressure sensitive adhesive.

Figure 3:
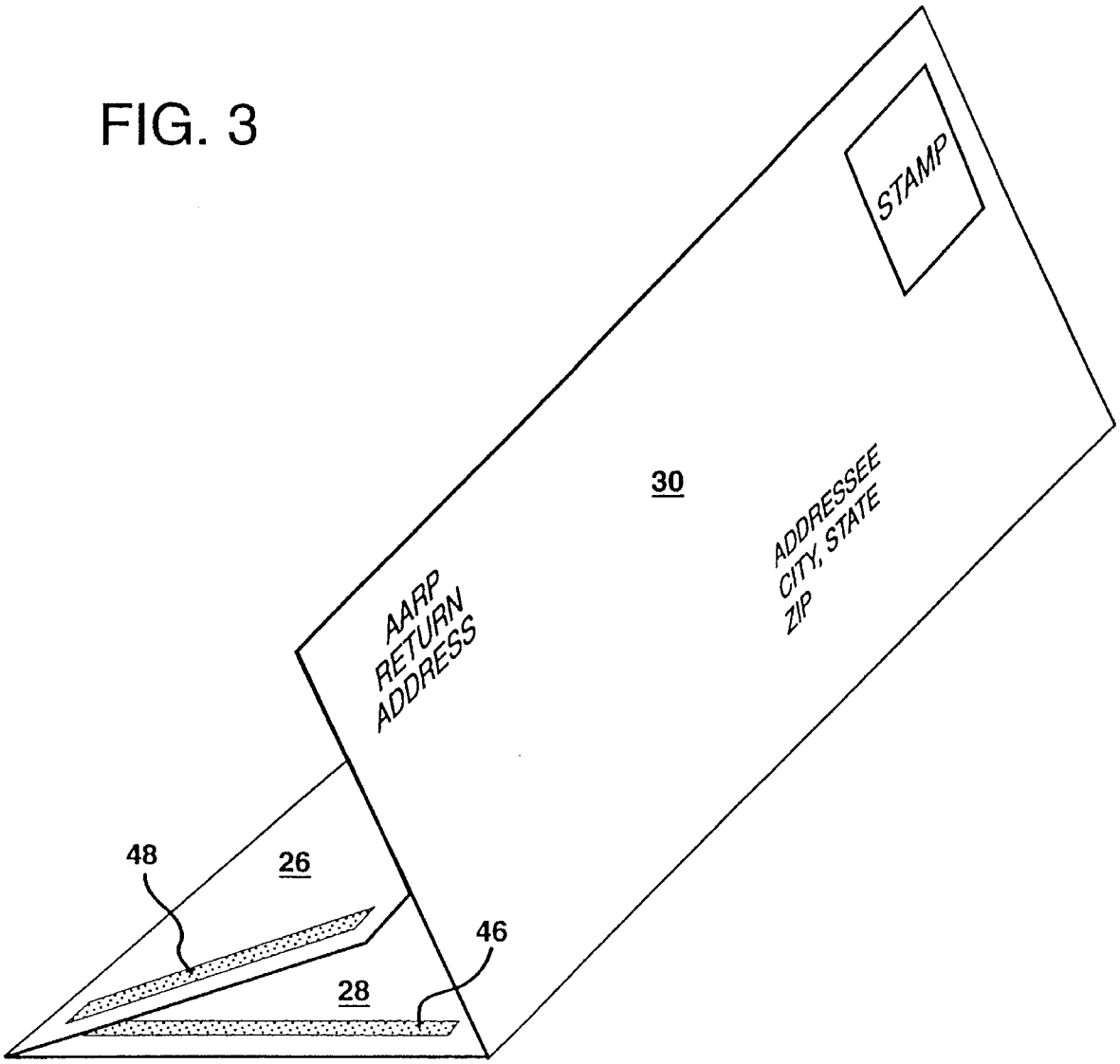
FIG. 3 is a perspective view of the mailer of FIGS. 1 and 2 folded in a C-fold arrangement.

A third adhesive pattern 48 is provided to seal third panel 30 and hold mailer 10 in place. The location of adhesive 48 is dependent upon the type of fold employed to close mailer 10. Turning to FIG. 3, it can be seen that mailer 10 can be folded in a C-fold arrangement wherein the second surfaces 16 of the first and second panel are in contact while the first surface 14 of the first panel 26 and the second surface 16 of the third panel are in contact. When employing a C-fold arrangement, third adhesive pattern 48 is disposed on the first surface 14 of first panel 26, the second surface 16 of third panel 30, or both, depending upon the adhesive employed. This allows third panel 30 to be sealed to first panel 26. Preferably, third adhesive pattern 48, is disposed adjacent the first and second longitudinal edges 18 and 20, and may be a hot-melt adhesive, remoist adhesive, pressure seal adhesive, or pressure sensitive adhesive. Again, one of ordinary skill in the art will recognize that certain adhesives, such as pressure seal or self adhesives, require corresponding adhesive patterns. FIGS. 1 and 2 show the location of adhesive 48 when employing a C-fold arrangement and pressure sensitive adhesive.

Figure 4:
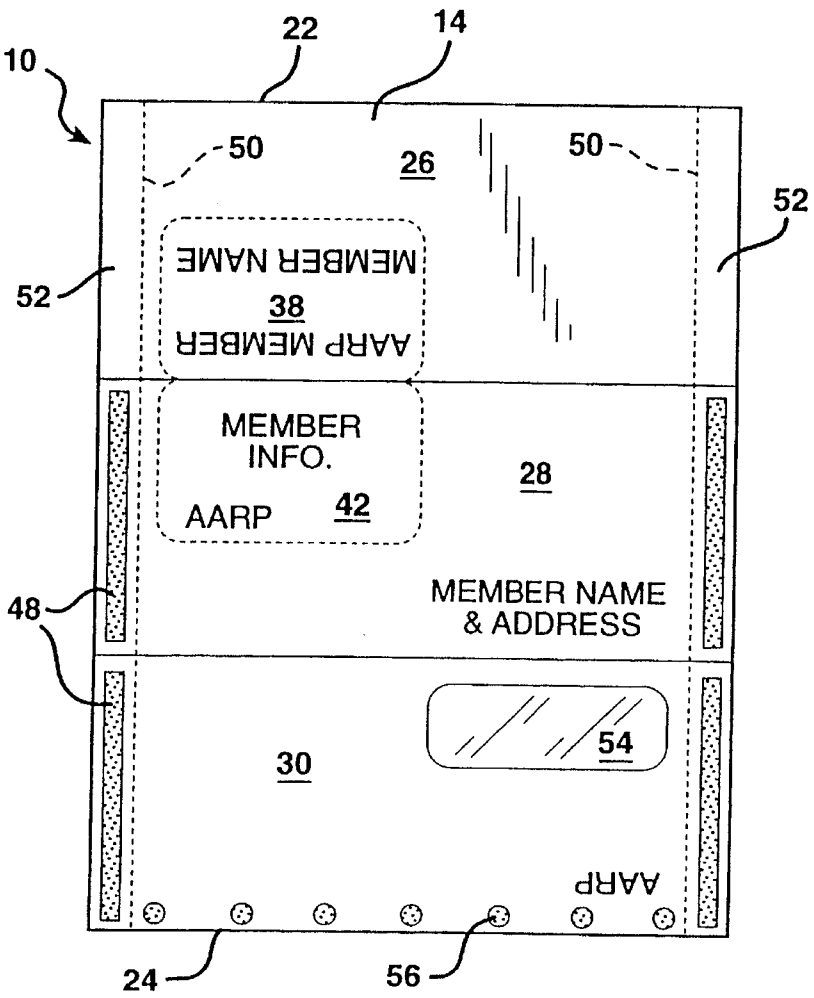
FIG. 4 is a plan view of the front (first) side of one embodiment of the business form or mailer intermediate of the present invention showing adhesive location for a Z-fold arrangement.
Figure 6:
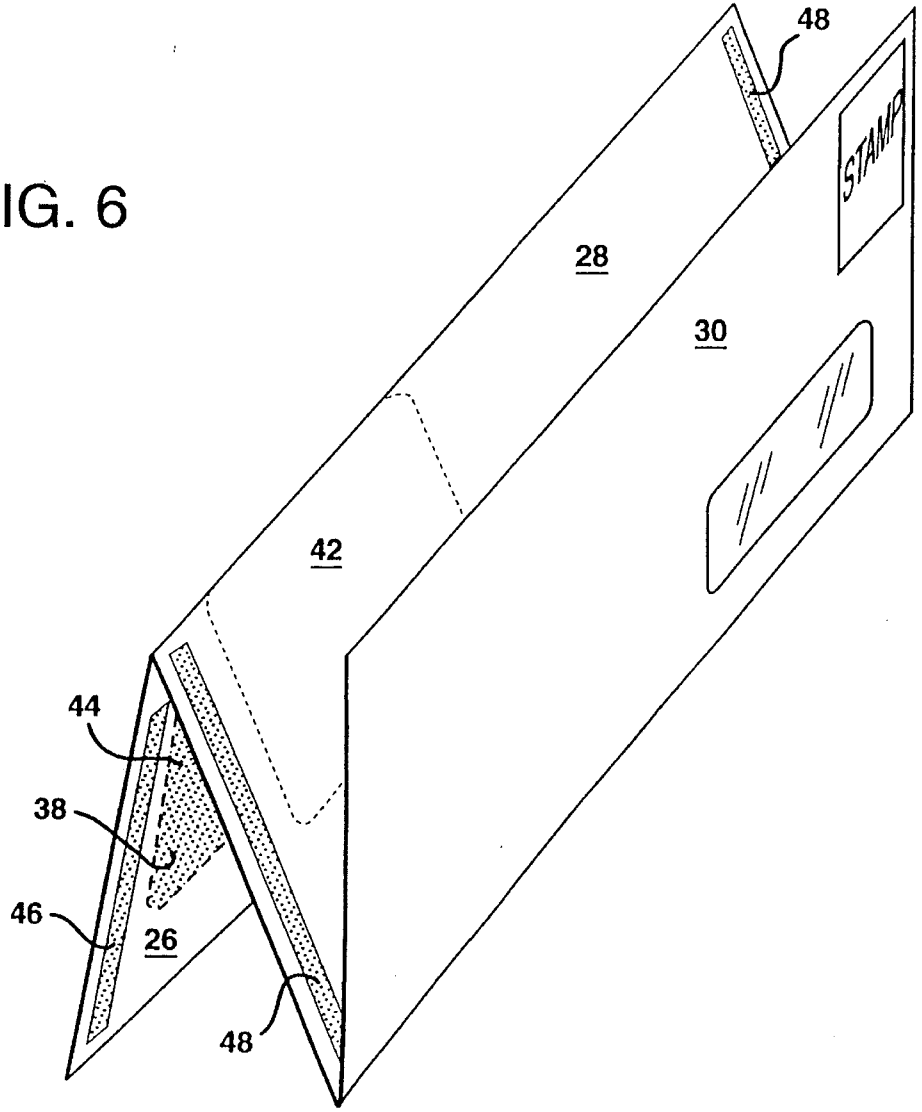
FIG. 6 is a perspective view of the mailer of FIGS. 4 and 5 folded in a Z-fold arrangement.

In an alternative embodiment, as shown in FIG. 6, mailer 10 may be folded in a Z-fold arrangement wherein mailer 10 is folded so that the second surfaces 16 of the first and second panels 26 and 28 are in contact while the first surfaces 14 of the second and third panels 28 and 30 are in contact. When a Z-fold arrangement is employed, third adhesive pattern 48 is provided on the first surface 14 of the second panel 26, the first surface 14 of the third panel 30 or both, depending upon the adhesive employed. This allows the second panel 28 to be sealed to the third panel 30. Again, third adhesive pattern 48 is preferably disposed adjacent the first and second longitudinal edges 18 and 20, and one of ordinary skill in the art will recognize that certain adhesives, such as pressure seal adhesives or self adhesives, require corresponding adhesive patterns. FIG. 4 shows the location of third adhesive pattern 48 on the first surface of the mailer 10 when a Z-fold and a seal sensitive adhesive is employed.

Figure 5:
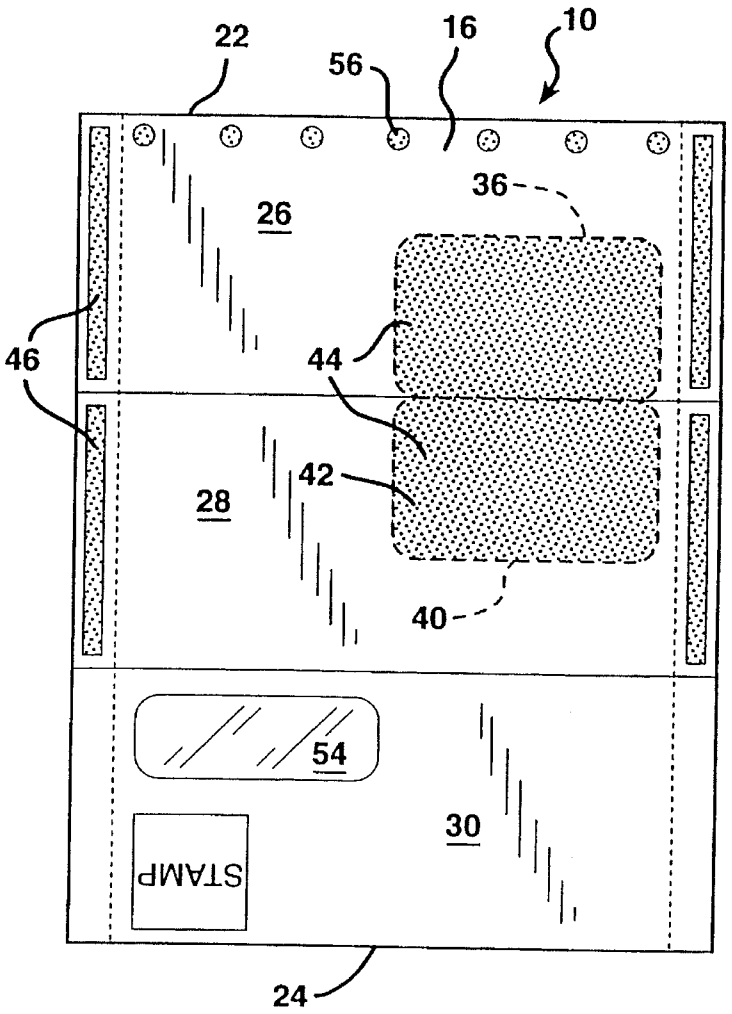
FIG. 5 is a plan view of the back (second) side of the embodiment of FIG. 4.

Still referring to FIGS. 4 and 5, there is seen a preferred feature of the present invention. Longitudinal lines of weakness 50 are provided adjacent both the first and second longitudinal edges 18 and 20, creating marginal strips 52 therebetween. The longitudinal lines of weakness 50 extend from both opposing end edges, 22 and 24. In other words, lines of weakness 50 pass through all of the available panels. When employing the lines of weakness 50, second and third adhesive patterns, 46 and 48, are preferably positioned to the inside of the lines of weakness 50 on marginal strips 52. By providing adhesives in this manner, once the mailer 10 is folded and sealed, the end user may simply remove the marginal strips 52 by tearing along the lines of weakness 50. When the marginal strips 52 are removed, the user will be able to open the mailer with relative ease. Yet, first ply 38 will remain adhered to second ply 42, thereby forming the two-ply card of the present invention.

Still referring to FIGS. 4 and 5, there is seen an additional embodiment of the present invention. In this embodiment, an address window 54 is provided in the mailer 10. Address window 54 may simply be a cut-out opening in substrate 12 thereby allowing the outgoing address to be viewed. Alternatively, address window 54 may be covered by any of a number of clear films that are well known in the art and which will allow the outgoing address to be viewed, while protecting the substrate 12 underneath the film.

To provide additional sealing of the mailer 10 when the mailer is folded in either a C-fold arrangement or a Z-fold arrangement, a fourth adhesive pattern 56 may be provided adjacent the first end edge 22, the second end edge 24, or both. Fourth adhesive pattern 56 may be provided on either the first surface 14 or the second surface 16, as shown in FIGS. 4 and 5, depending upon the type of fold and the amount of sealing desired.

Figure 7:
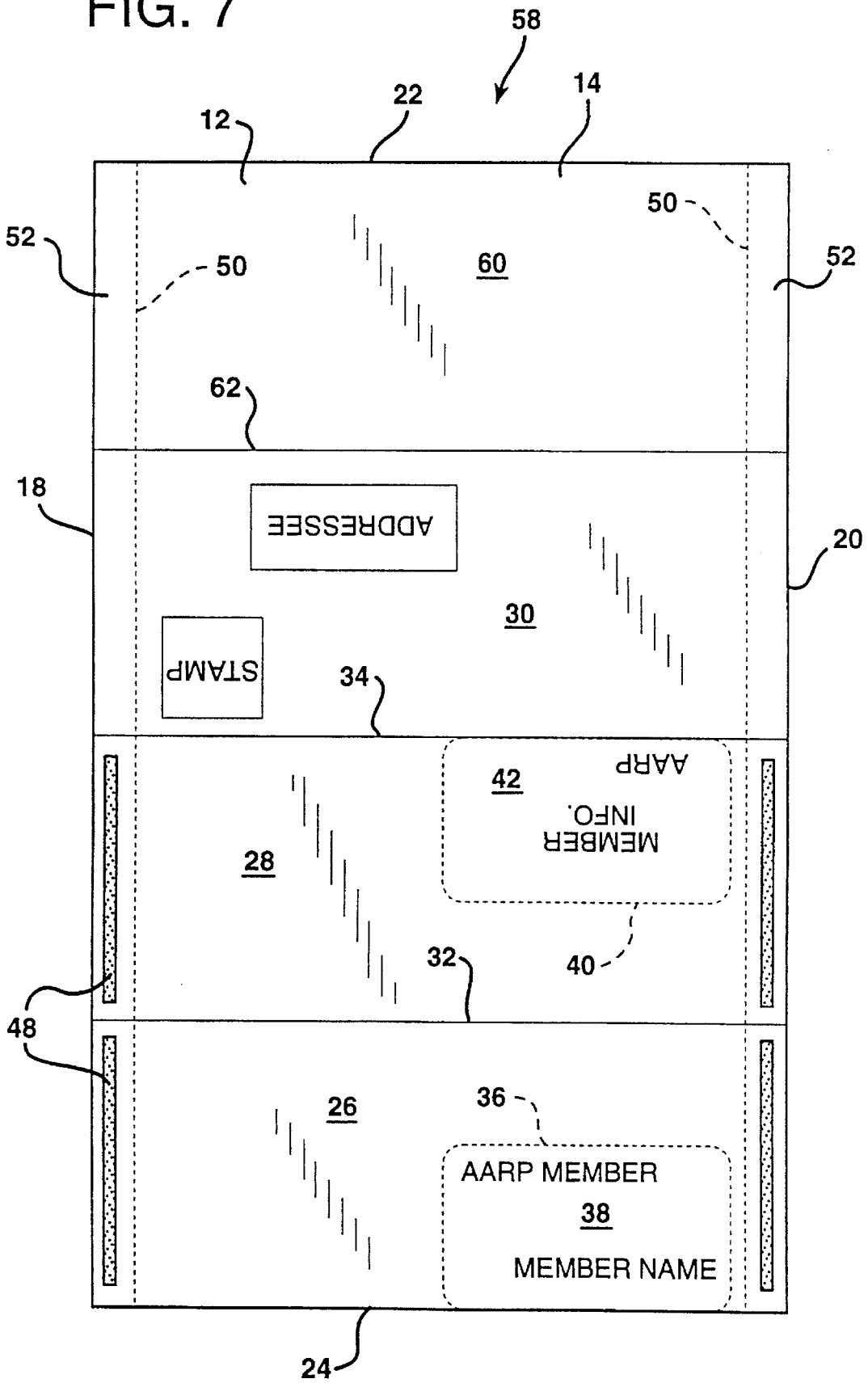
FIG. 7 is a plan view of the front (first) side of one embodiment of the business form or mailer intermediate of the present invention showing four panels and adhesive location for a double C-fold arrangement.
Figure 8:
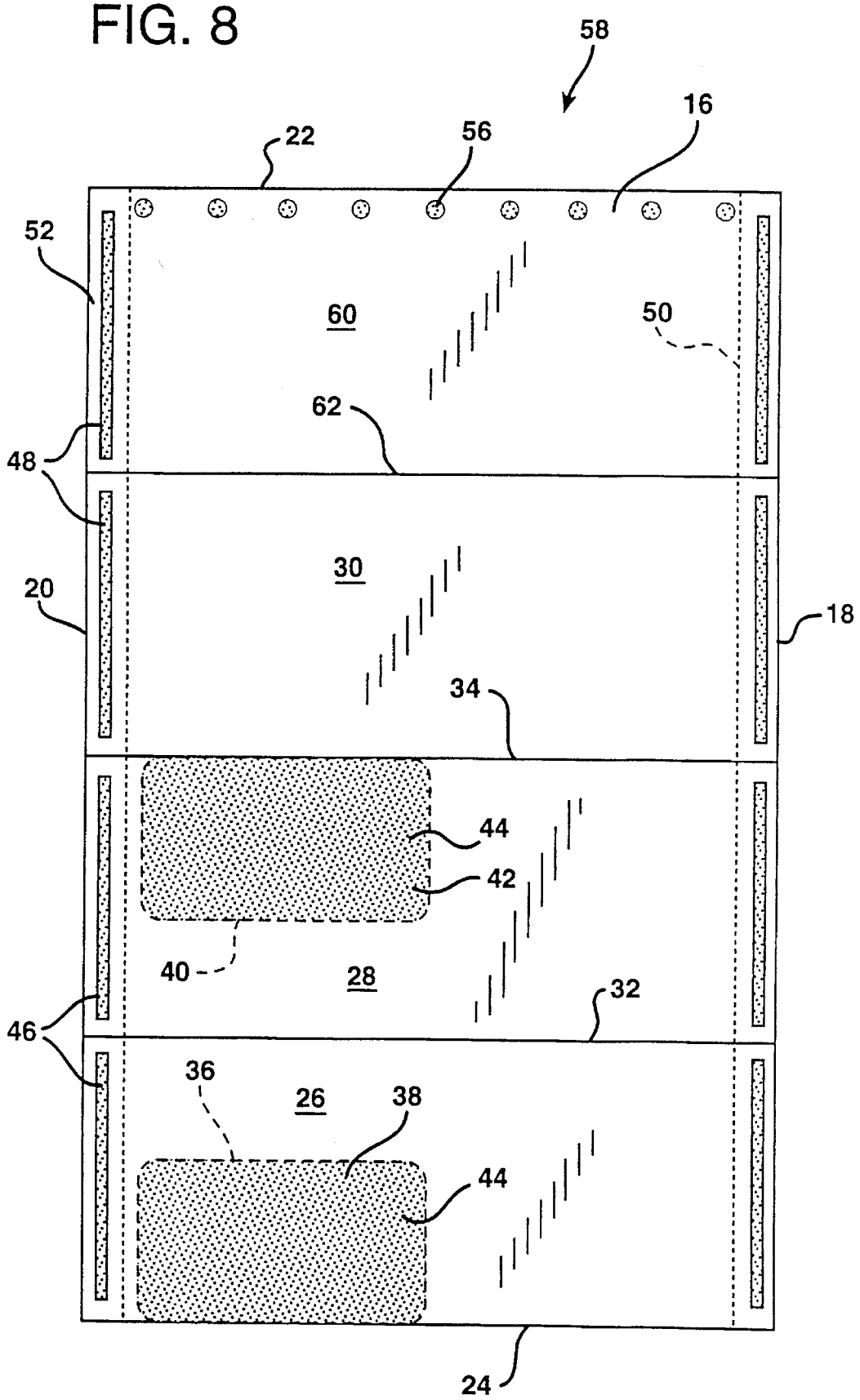
FIG. 8 is a plan view of the back (second) side of the embodiment of FIG. 7.

Turning now to FIGS. 7 and 8, there is seen the four panel mailer 58 of the present invention. Four panel mailer 58 includes an additional or fourth panel 60, adjacent the third panel 30. Fourth panel 60 is separated from third panel 30 by a third fold line 62. Four panel mailer 58 contains the same essential features as did the three panel mailer 10. That is, substrate 12, first and second surfaces 14 and 16, first and second longitudinal edges 18 and 20, first and second end edges 22 and 24, first, second and third panels 26, 28 and 30, first and second fold lines 32 and 34, lines of weakness for first and second plies 36 and 40, first and second plies 38 and 42, and first and second adhesive patterns 44 and 46 are all as described above for the three panel mailer 10.

In addition, four panel mailer 58 may include other features, as described above, such as lines of weakness 50 extending through all four panels thereby creating marginal strips 52, address window 54 disposed in the third or fourth panels 30 or 60, respectively, and fourth adhesive 56 provided adjacent end edges 22 and 24 or in the case of the four panel mailer 58, adjacent the second fold line 34 as well. Four panel mailer 58 may also include third adhesive 48 to help seal the mailer. Again, the location of third adhesive 48 is dependent upon the type of fold employed to seal mailer 58.

Figure 9:
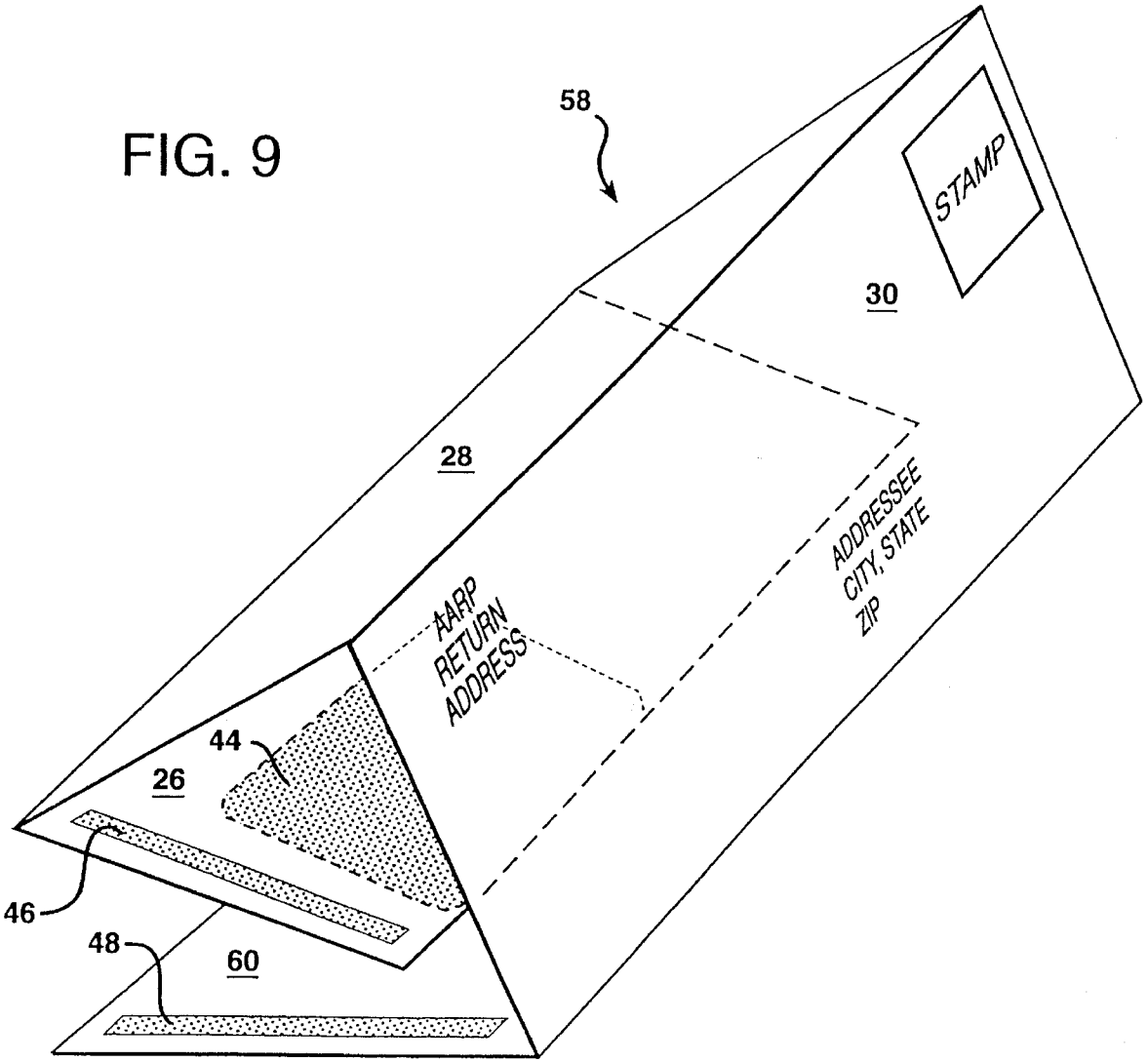
FIG. 9 is a perspective view of the mailer of FIGS. 7 and 8 folded in a double C-fold arrangement.

Turning to FIG. 9, there is seen mailer 58 of the present invention, folded in a double C-fold arrangement. That is, mailer 58 is folded so that the second surfaces 16 of the first and second panels 26 and 28 are in contact, the first surface 14 of the first panel 26 and the second surface 16 of the third panel are in contact, and the second surface 16 of the fourth panel 60 and the first surface 14 of the second panel 28 are in contact.

When employing a double C-fold arrangement for the mailer 58, third adhesive pattern 48 is provided on the second surface 16 in at least one of the third or fourth panels, 30 and 60, and on the first surface of at least one of the first and second panels, depending upon the adhesive employed. In other words, to seal the fourth panel 60 to second panel 28, adhesive 48 would be placed in the second surface 16 of fourth panel 60, the first surface 14 of second panel 28, or both. To seal the first panel 26 to the third panel 60, adhesive 48 would be provided on the second surface 16 of third panel 30, the first surface 14 of the first panel 26, or both. Third adhesive pattern 48 is preferably disposed adjacent the first and second longitudinal edges 18 and 20. One of ordinary skill in the art will recognize that certain adhesives, such as pressure seal or self adhesives, require mated adhesive patterns. FIGS. 7 and 8 show the location of third adhesive pattern 48 on the front and back of the mailer 58, respectively, when employing a double C-fold arrangement and a pressure seal adhesive.

Figure 12:
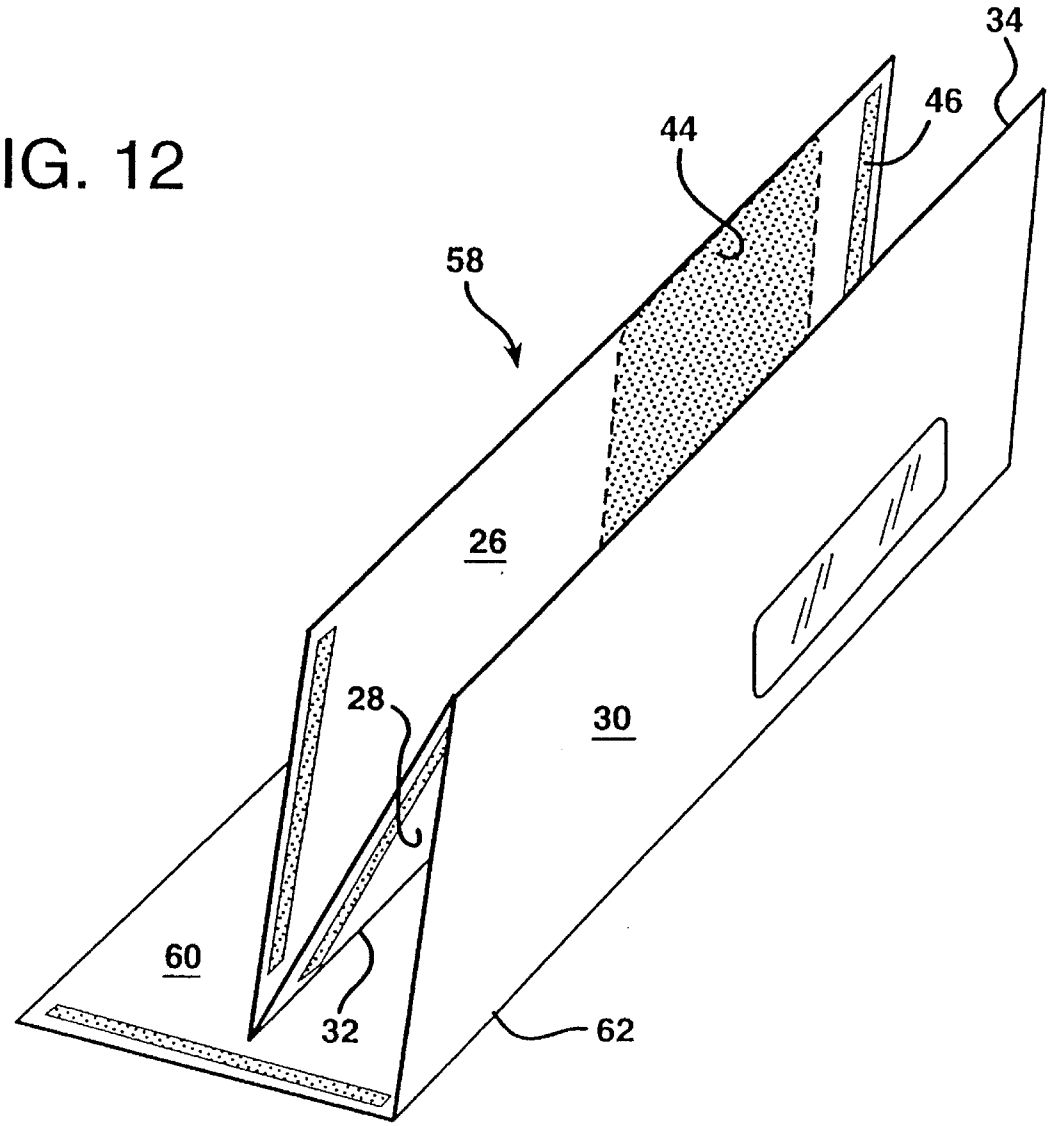
FIG. 12 is a perspective view of the mailer of FIGS. 10 and 11 folded in a double V-fold arrangement.

Alternatively, the mailer 58 of the present invention may be folded in a double V-fold arrangement. As seen in FIG. 12, in this arrangement folding along the second fold line 34, places the first surfaces 14 of the first and second panels 26 and 28 in contact with the first surfaces 14 of the fourth and third panels 60 and 30, respectively. The mailer 58 is then folded about the first and third fold lines 32 and 62, placing in contact the second surfaces 16 of the first and second panels 26 and 28, thereby forming the two-ply card.

Figure 10:
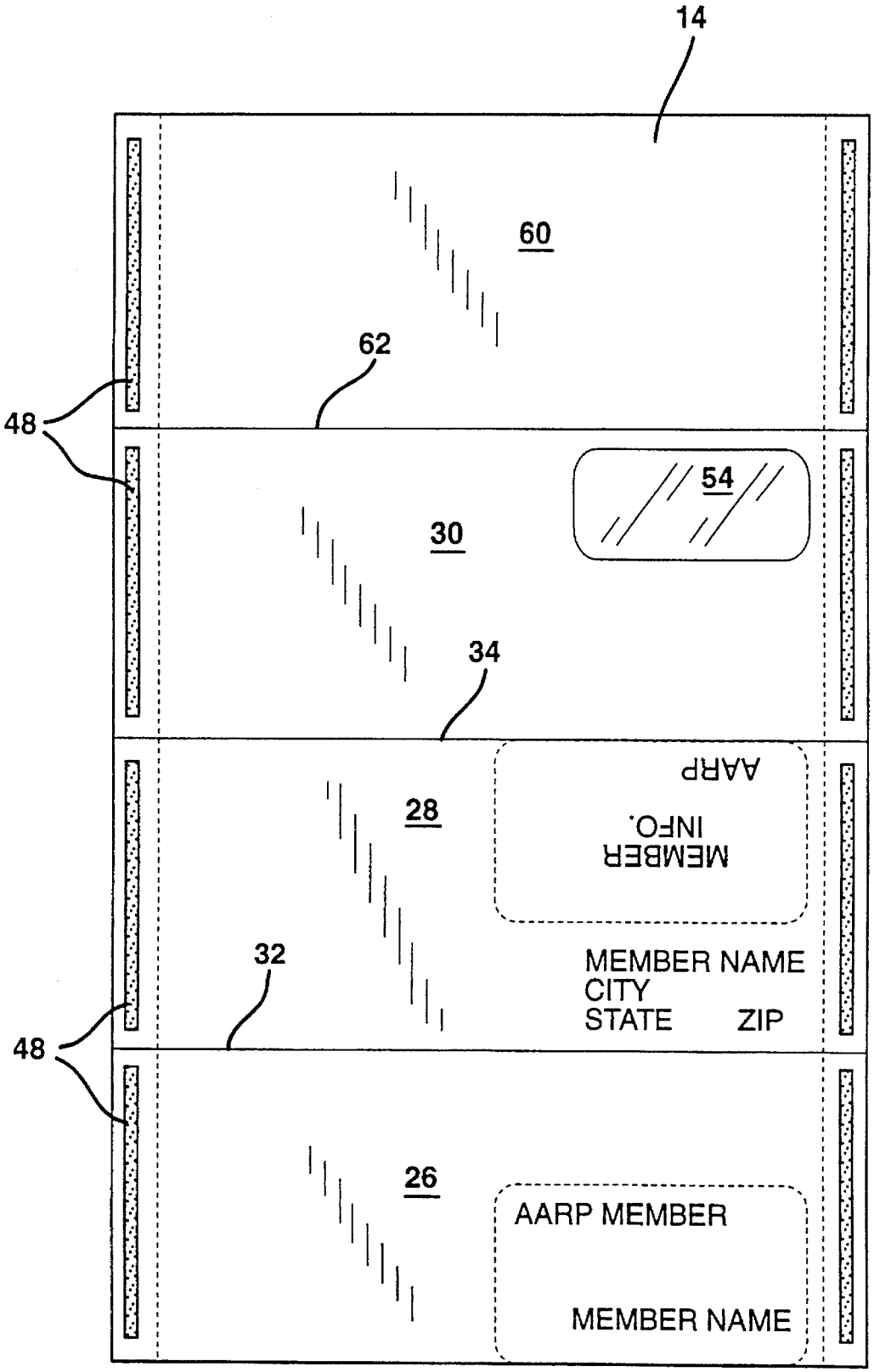
FIG. 10 is a plan view of the front (first) side of one embodiment of the business form or mailer intermediate of the present invention showing four panels and adhesive location for a double V-fold arrangement.
Figure 11:
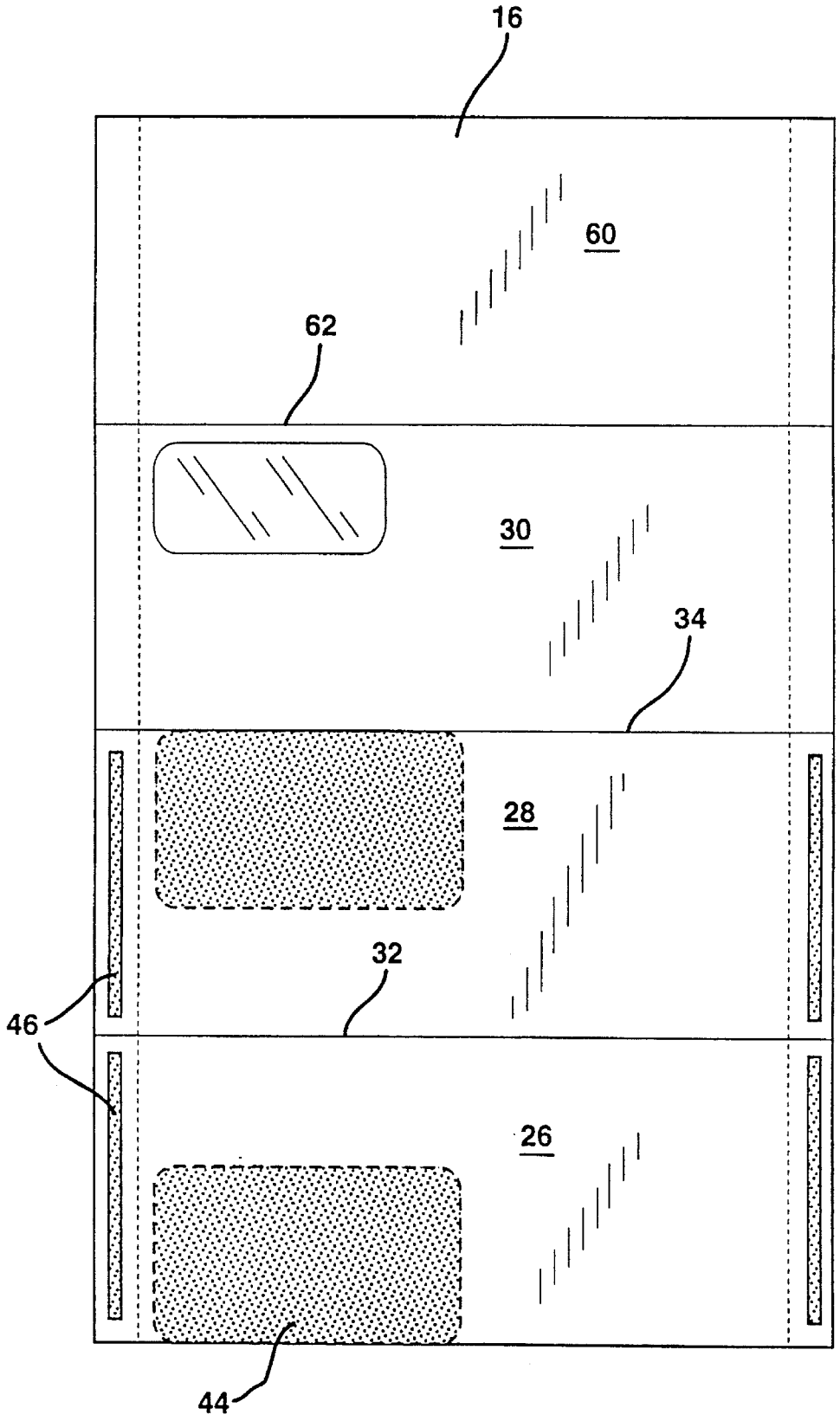
FIG. 11 is a plan view of the back (second) side of the embodiment of FIG. 10.

When employing the double V-fold arrangement, third adhesive 48 is provided on the first surface 14 of the second panel 28, third panel 30, or both, and on the first surface 14 of the first panel 26, the fourth panel 60, or both. Thus, when mailer 58 is folded about the second fold line 34, the first and fourth panels 26 and 60 will adhere, and the second and third panels 28 and 30 will adhere. Again, third adhesive pattern 48 is preferably disposed adjacent the first and second longitudinal edges 18 and 20 and one of ordinary skill in the art will recognize that certain adhesives, such as pressure seal or self adhesives, require mated adhesive patterns. FIGS. 10 and 11 show the location of third adhesive pattern 48 on the first surface 14 of the mailer 58 when employing a double V-fold arrangement and a pressure sensitive adhesive.

Figure 13:
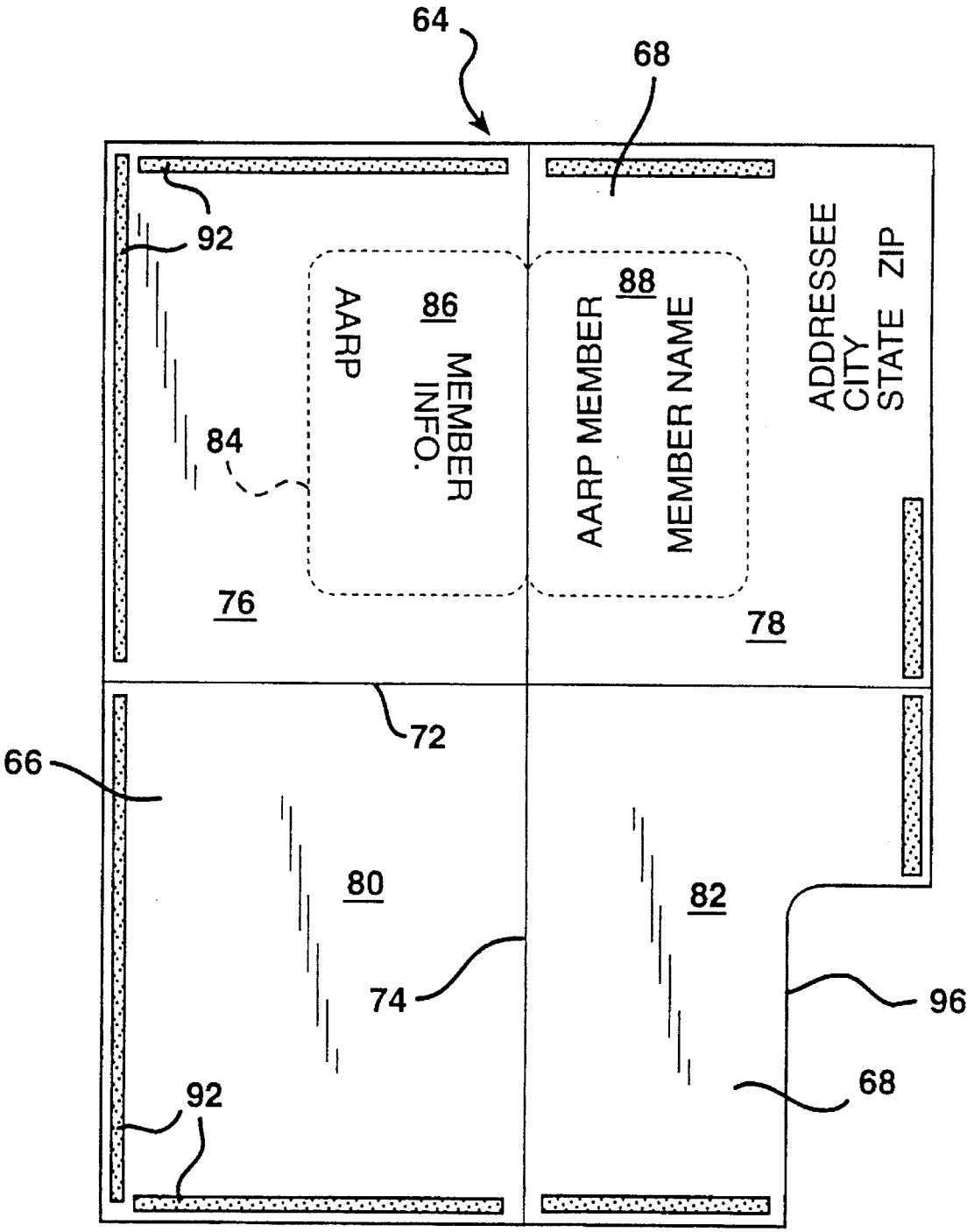
FIG. 13 is a plan view of the front (first) side of one embodiment of the business form or mailer intermediate of the present invention showing four panels in a side-by-side arrangement.
Figure 14:
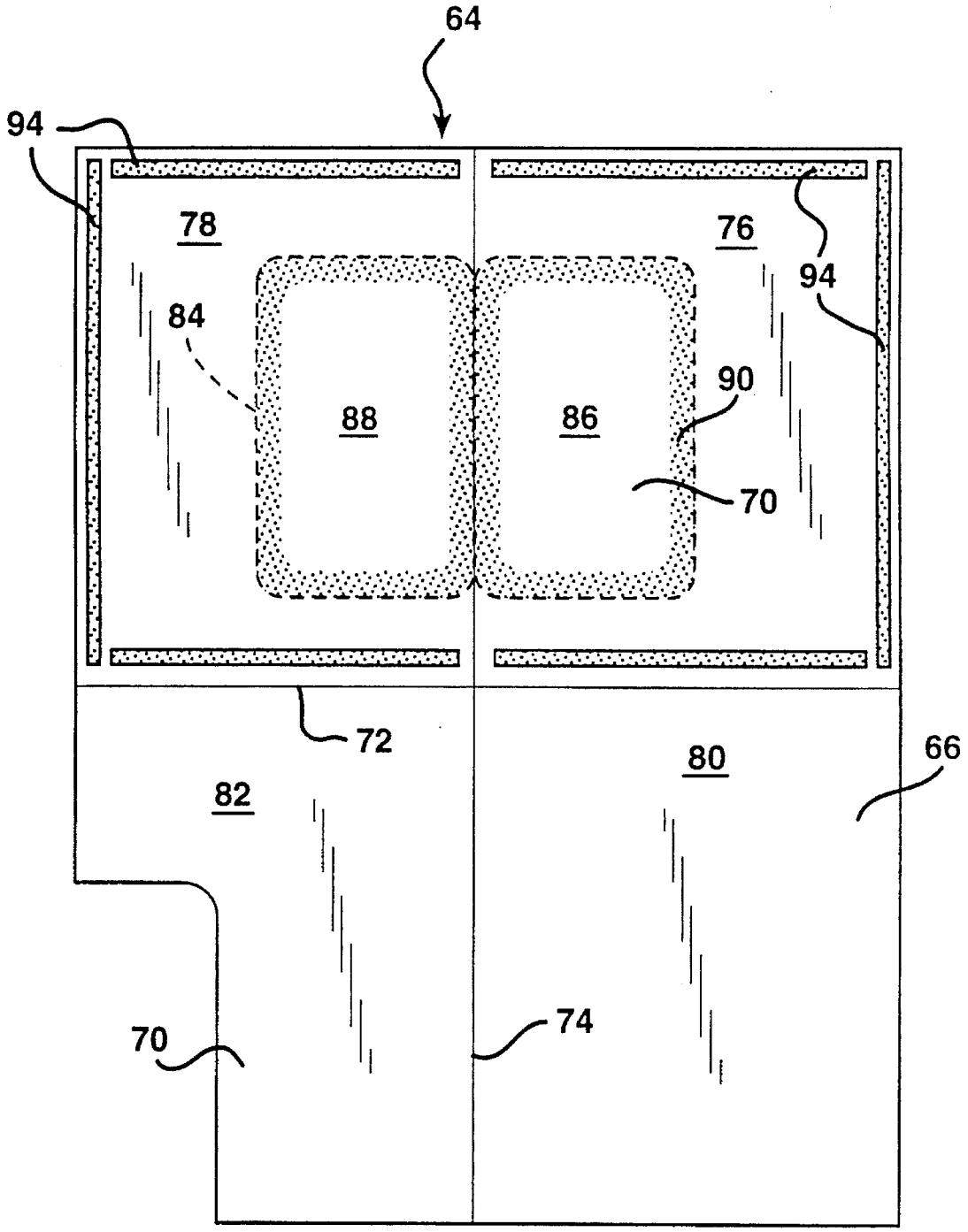
FIG. 14 is a plan view of the back (second) side of the embodiment of FIG. 13.

Turning now to FIGS. 13 and 14, there is seen an additional embodiment of the present invention. FIGS. 13 and 14 show a four panel mailer 64 of the present invention wherein the four panels are in a side-by-side arrangement. The mailer 64 comprises a substrate sheet 66 having a first surface 68 and a second surface 70. Substrate 66 may be of the identical material to the substrate 12 of the three panel mailer 10 and the four panel mailer 58. The substrate 66 includes a first fold line 72 and a second fold line 74, thereby dividing the substrate 66 into a first panel 76, a second panel 78, a third panel 80 and a fourth panel 82. The first fold line 72 separates the first and second panels 76 and 78, from the third and fourth panels 80 and 82, while the second fold line 74 separates the first and third panels 76 and 80 from the second and fourth panels 78 and 82.

Lines of weakness 84 may be provided in two adjacent panels so that first ply 86 and second ply 88 are formed. The lines of weakness are provided so that first ply 86 and second ply 88 are in separate, but adjacent, plies. Further, first and second plies 86 and 88 are arranged within the adjacent panels so that, when mailer 64 is folded about the first and second fold lines 72 and 74, the second surface 70 of the two plies are in contact, thereby forming the two-ply card. Thus, first and second plies 86 and 88, may be in either the first and second panels 76 and 78, the fourth and third panels 80 and 82, the first and third panels 76 and 80, or the second and fourth panels 78 and 82.

To form the two-ply card of the present invention, a first adhesive pattern 90 is provided on the second surface of the first ply 86, the second ply 88, or both. Further, first adhesive pattern 90 may be on all or any portion of the plies, such as the perimeter portions. First adhesive pattern 90 then acts to adhere first ply 86 to second ply 88, thereby forming the two-ply card of the present invention.

Figure 16:
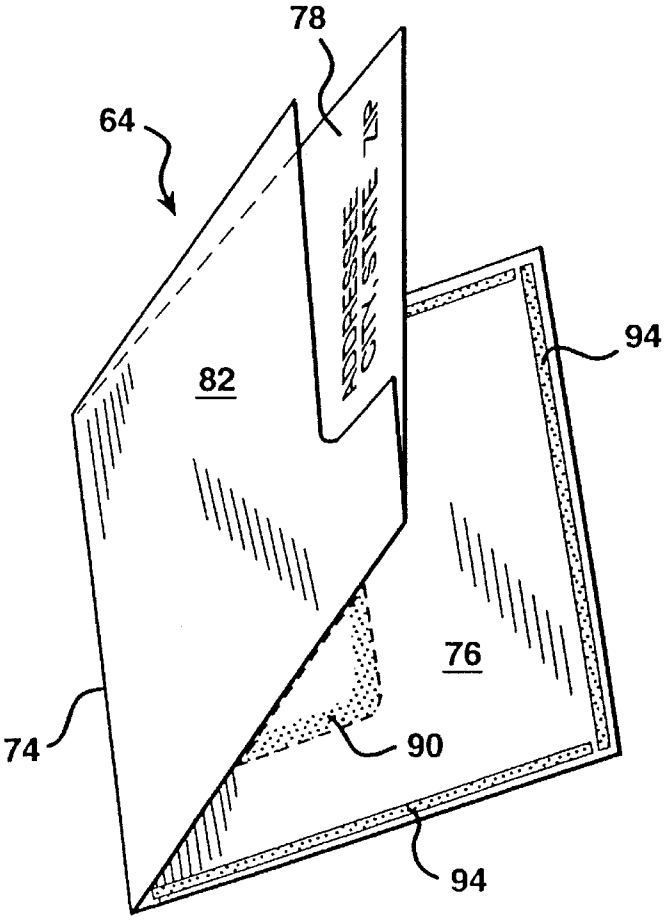
FIG. 16 is a perspective of the mailer of FIGS. 13 and 14 showing the mailer folded about a first and second fold lines.
Figure 15:
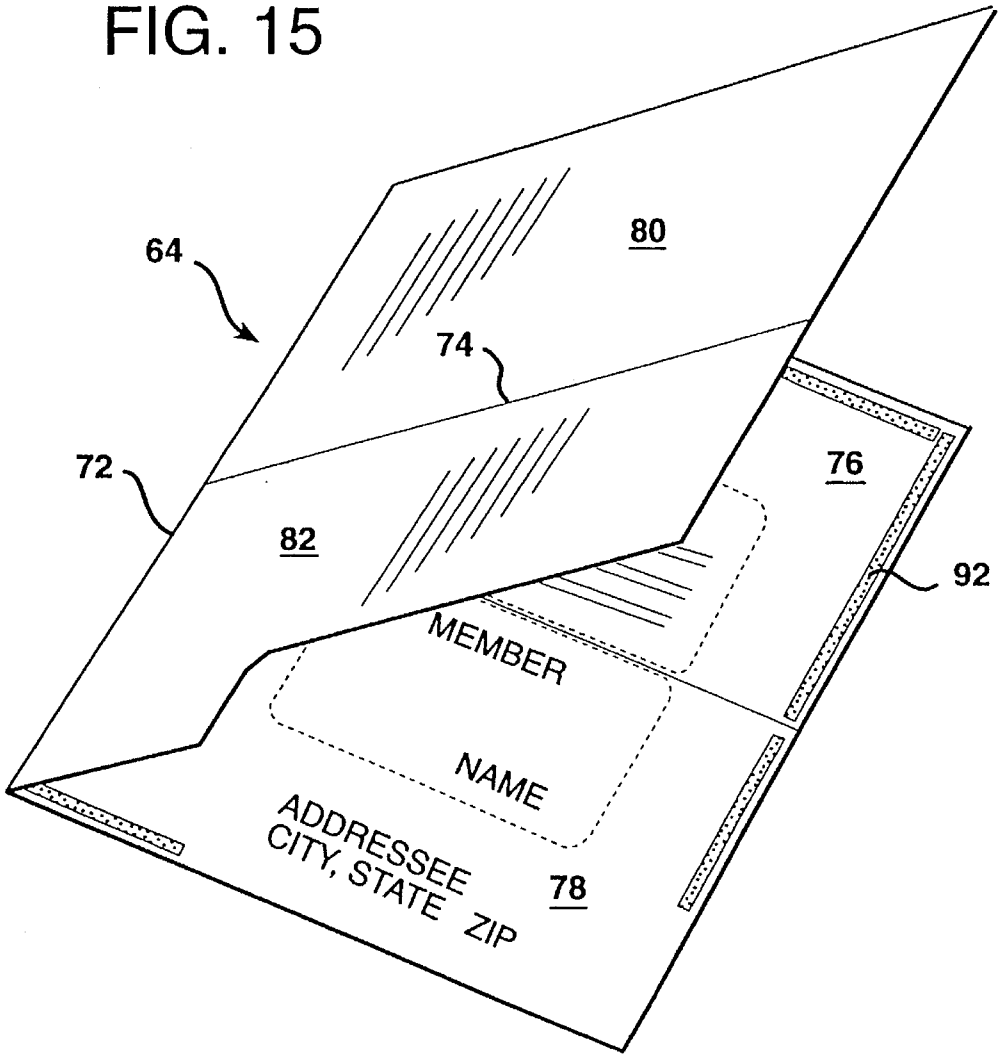
FIG. 15 is a perspective of the mailer of FIGS. 13 and 14 showing the mailer folded about a first fold line.

To seal the mailer 64, additional adhesive patterns may be employed. A second adhesive pattern 92 may be provided on the first surface 68 of any of the four panels to help hold the first surface together when mailer 64 is folded about the first fold line 72, as shown in FIG. 15. A third adhesive pattern 94 may be provided on the second surface 70 of any of the four panels to help hold the mailer in place when the mailer 64 is folded about the second fold line 74, as shown in FIG. 16. In addition, mailer 64 may include an address window 96 formed into one of the four panels. Address window 96 may be in the form of a cut away portion, as in FIG. 13, or in the form of a die cut hole, as described in conjunction with the three panel mailer 10.

Of course, one of ordinary skill in the art will recognize that a business form including the two-ply card according to the present invention may easily be produced by eliminating various adhesive patterns. By removing the second, third and fourth adhesive patterns in any of the three major embodiments, the three panel mailer 10, the four panel mailer 58 and the side-by-side panel mailer 64, there is formed a business form wherein a two-ply card is formed from folding and the activation of the first adhesive pattern. The business form may then be added to an envelope or package for mailing. However, if so desired, the second, third or fourth adhesive patterns in any of the three mailer embodiments 10, 58 and 64, respectively, may be included while still forming a business form to be included in an envelope or package.

Having described the invention in detail and by reference to the preferred embodiment thereof, it will be apparent that modifications and variations are possible without departing from the scope of the invention which is defined in the appended claims.

What is claimed is:

1. A business form or mailer intermediate comprising:

a substrate sheet having first and second surfaces, first and second opposite parallel longitudinal edges, and first and second opposite end edges;

at least first and second transverse fold lines formed in said substrate perpendicular to said parallel longitudinal edges, dividing said substrate into at least first, second, and third panels, said first fold line separating said first and second panels and said second fold line separating said second and third panels;

lines of weakness disposed in said first and second panels thereby forming first and second plies, respectively, and;

a first adhesive pattern provided on said second surface of at least one of said first and second plies so that when said substrate sheet is folded about said first fold line said second surfaces of said first and second plies lie in contact forming a two-ply card.

2. The business form or mailer intermediate as claimed in claim 1 further including lines of weakness adjacent said first and second longitudinal edges in said at least first, second and third panels.

3. The business form or mailer intermediate as claimed in claim 1 further including a second adhesive pattern provided on said second surface in at least one of said first and second panels.

4. The business form or mailer intermediate as claimed in claim 3 further including a third adhesive provided on at least one of said first surface of said first panel or said second surface of said third panel.

5. The business form or mailer intermediate as claimed in claim 3 further including a third adhesive pattern provided on said first surface of at least one of said second or third panels.

6. The business form or mailer intermediate as claimed in claim 1 further including an address window formed in one of said first or third panels.

7. The business form or mailer intermediate as claimed in claim 1 further including a fourth adhesive pattern adjacent one of said first and second opposite end edges.

8. The business form or mailer intermediate as claimed in claim 1 further including a fourth panel adjacent said third panel and separated by a third fold line.

9. The business form or mailer intermediate as claimed in claim 8 further including lines of weakness adjacent said first and second longitudinal edges in said first, second, third and fourth panels.

10. The business form or mailer intermediate as claimed in claim 9 further including a second adhesive pattern provided on said second surface of at least one of said first and second panels.

11. The business form or mailer intermediate as claimed in claim 9 further including a third adhesive pattern provided on said second surface of at least one of said third and fourth panels and on said first surface of at least one of said first and second panels.

12. The business form or mailer intermediate as claimed in claim 9 further including a third adhesive pattern provided on said first surface of at least one of said second and third panels and on said first surface of at least one of said first and fourth panels.

13. The business form or mailer intermediate as claimed in claim 8 further including an address window formed in one of said first or third panels.

14. The business form or mailer intermediate as claimed in claim 8 further including a fourth adhesive pattern adjacent one of said first and second opposite end edges.

15. A business form or mailer intermediate comprising:

a substrate sheet having first and second surfaces;

first and second fold lines formed in said substrate dividing said substrate into first, second, third and fourth panels, said first fold line separating said first and second panels from said third and fourth panels and said second fold line separating said first and third panels from said second and fourth panels;

lines of weakness disposed in two adjacent panels thereby forming first and second plies, respectively, and;

a first adhesive pattern provided on said second surface of at least one of said first and second plies so that when said substrate sheet is folded about one of said first or second fold lines said first and second plies lie in contact and adhere forming a two-ply card.

16. The business form or mailer intermediate as claimed in claim 15 further including a second adhesive pattern provided on said first surface of at least one of said first, second, third or fourth panels.

17. The business form or mailer intermediate as claimed in claim 15 further including a third adhesive pattern disposed on said second surface of at least one of said first, second, third or fourth panels.

18. The business form or mailer intermediate as claimed in claim 15 further including an address window formed in one of said first, second, third or fourth panels.

19. A business form or mailer intermediate comprising:

a substrate sheet having first and second surfaces, first and second opposite parallel longitudinal edges, and first and second opposite end edges;

at least first and second transverse fold lines formed in said substrate perpendicular to said parallel longitudinal edges, dividing said substrate into at least first, second, and third panels, said first fold line separating said first and second panels and said second fold line separating said second and third panels;

lines of weakness disposed in said first and second panels thereby forming first and second plies, respectively, said first and second plies bearing identification indicia; and, a first adhesive pattern provided on said second surface of at least one of said first and second plies so that when said substrate sheet is folded about said first fold line said second surfaces of said first and second plies lie in contact forming a two-ply card bearing said identification indicia.

* * * * *